US012791221B2

(12) United States Patent
Jang et al.

(10) Patent No.: US 12,791,221 B2
(45) Date of Patent: Nov. 10, 2026

(54) DAMPER DEVICE AND VENTILATION SYSTEM COMPRISING SAME

(71) Applicant: Samsung Electronics Co., Ltd., Suwon-si (KR)

(72) Inventors: Eomji Jang, Suwon-si (KR); Kyunghoon Kim, Suwon-si (KR); Sunggoo Kim, Suwon-si (KR); Hyeongjoon Seo, Suwon-si (KR); Jaehyoung Sim, Suwon-si (KR); Sungjune Cho, Suwon-si (KR); Taesung Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 317 days.

(21) Appl. No.: 18/406,771

(22) Filed: Jan. 8, 2024

(65) Prior Publication Data

US 2024/0142135 A1 May 2, 2024

Related U.S. Application Data

(63) Continuation of application No. PCT/KR2022/011030, filed on Jul. 27, 2022.

(30) Foreign Application Priority Data

Aug. 18, 2021 (KR) ..... 10-2021-0108481

(51) Int. Cl.
*F24F 13/14* (2006.01)
*F24F 3/14* (2006.01)
(Continued)

(52) U.S. Cl.
CPC .. *F24F 13/1426* (2013.01); *F24F 2013/1433* (2013.01)

(58) Field of Classification Search
CPC .... F24F 13/14; F24F 13/1406; F24F 13/1426; F24F 13/1433; F25D 2323/022
See application file for complete search history.

(56) References Cited

U.S. PATENT DOCUMENTS 4,949,625 A 8/1990 Miklos
9,366,472 B2 * 6/2016 Seo ..... E05F 15/603
(Continued)

FOREIGN PATENT DOCUMENTS

CN 107270512 A 10/2017
CN 110409915 B 1/2021
(Continued)

OTHER PUBLICATIONS

International Search Report and Written Opinion of the International Searching Authority dated Nov. 15, 2022, in connection with International Application No. PCT/KR2022/011030, 9 pages.
(Continued)

*Primary Examiner* — Steven S Anderson, II

(57) ABSTRACT

A damper device according to an embodiment of the disclosure includes a frame having an opening and a blade coupled to the frame to open/close the opening, the damper device including a first bracket provided on the frame such that the blade is rotatably coupled thereto, a second bracket provided to correspond to the first bracket, a first hole and a second hole formed bilaterally symmetrically on the first bracket and the second bracket, and a motor connected to rotate the blade through one of the first hole and the second hole, wherein the blade is connected to the first hole when rotated in a first direction, and is connected to the second hole when rotated in a second direction opposite to the first direction.

16 Claims, 11 Drawing Sheets

(51) Int. Cl.
*F24F 7/08* (2006.01)
*F24F 12/00* (2006.01)

(56) References Cited

U.S. PATENT DOCUMENTS

| | | | | |
|---|---|---|---|---|
| 2009/0033189 | A1* | 2/2009 | Glanz | E05F 15/63 49/31 |
| 2016/0054046 | A1 | 2/2016 | Sim | |
| 2023/0097204 | A1 | 3/2023 | Hwang | |

FOREIGN PATENT DOCUMENTS

| | | | |
|---|---|---|---|
| JP | 2005-241051 | A | 9/2005 |
| KR | 20-0382009 | Y1 | 4/2005 |
| KR | 10-2005-0078377 | A | 8/2005 |
| KR | 10-2007-0074220 | A | 7/2007 |
| KR | 10-0757391 | B1 | 9/2007 |
| KR | 10-0971231 | B1 | 7/2010 |
| KR | 10-2012-0057188 | A | 6/2012 |
| KR | 10-1217605 | B1 | 1/2013 |
| KR | 10-2014-0110236 | A | 9/2014 |
| KR | 10-2014-0133437 | A | 11/2014 |
| KR | 10-1549083 | B1 | 9/2015 |
| KR | 10-1554013 | B1 | 9/2015 |
| KR | 10-1554722 | B1 | 9/2015 |
| KR | 10-1554922 | B1 | 9/2015 |
| KR | 10-2017-0099392 | A | 8/2017 |
| KR | 20-0489341 | Y1 | 6/2019 |
| KR | 10-2020-0002452 | A | 1/2020 |
| KR | 10-2089784 | B1 | 3/2020 |
| KR | 10-2248317 | B1 | 5/2021 |

OTHER PUBLICATIONS

Office Action issued May 19, 2026, in connection with Korean Patent Application No. 10-2021-0108481, 11 pages.

* cited by examiner

DAMPER DEVICE AND VENTILATION SYSTEM COMPRISING SAME

CROSS-REFERENCE TO RELATED APPLICATIONS

This application is a Bypass Continuation of International Application No. PCT/KR2022/011030, filed Jul. 27, 2022, which claims priority to Korean Patent Application No. 10-2021-0108481, filed Aug. 18, 2021, the disclosures of which are herein incorporated by reference in their entirety.

BACKGROUND

1. Field

The disclosure relates to a damper device, and more particularly, to a damper device used in a ventilation system for providing comfortable air.

2. Description of the Related Art

In general, ventilation devices are devices that ventilate an indoor space by introducing outdoor air into the indoor space or by exchanging indoor air with outdoor air.

Conventional ventilation devices may only regulate the temperature and humidity of an indoor space by exchanging heat between outdoor air and indoor air generated while passing through a heat exchanger. As a result, the dehumidification of the outdoor air supplied to the indoor space is insufficient, and it is difficult to maintain a comfortable indoor temperature and humidity.

SUMMARY

The present disclosure is directed to providing a damper device capable of being symmetrically arranged with the same configuration in a ventilation device that needs to be provided symmetrically, and a ventilation system including the same.

Further, the present disclosure is directed to providing a damper device applicable to a ventilation system capable of adjusting the humidity of air supplied to an indoor space to a comfortable state.

According to an embodiment of the disclosure, a damper device includes a frame having an opening; a first bracket provided on the frame and including a first hole, a second bracket provided to correspond to the first bracket and including a second hole that is bilaterally symmetrical to the first hole of the first bracket, a blade rotatably coupled to the first bracket and configured to open or close the opening; and a motor connected to rotate the blade through one of the first hole and the second hole, wherein the blade is connected to the first hole when rotated in a first direction and is connected to the second hole when rotated in a second direction opposite to the first direction.

The blade may further include a first hinge shaft and a second hinge shaft formed to be attached to one of the first hole and the second hole.

The damper device may further include a rotation guide provided between the motor and one of the first hinge shaft and the second hinge shaft to guide a rotation of the blade.

The rotation guide may include a motor coupling coupled to a motor shaft of the motor, and a hinge coupling extending integrally from the motor coupling and coupled to one of the first hinge shaft and the second hinge shaft.

The hinge coupling may further include a support surface having a D-cut shape, a portion of which is formed to be flat.

The one of the first hinge shaft and the second hinge shaft may further include a hinge groove corresponding to the support surface and having a D-cut shape.

The blade may further include a seal provided in close contact around the opening so as to maintain airtightness.

The seal may include either a rubber or a resin.

The one of the first bracket and the second bracket may further include a motor installation portion on which the motor is mounted.

The motor installation portion may further include a plurality of mounting holes formed near the first hole and the second hole.

According to an embodiment of the disclosure, a ventilation system includes a ventilation device including an intake flow path for drawing outdoor air into an interior of the ventilation device, an exhaust flow path for discharging indoor air to an outside of the ventilation device, and a connecting flow path connecting the intake flow path and at least a portion of the exhaust flow path, a damper device provided to open and close the connecting flow path, wherein the damper device includes a frame having an opening, a first bracket provided on the frame and including a first hole, a second bracket provided to correspond to the first bracket and including a second hole, wherein the first hole and the second hole are formed in the first bracket and the second bracket to enable left and right mirroring, respectively, a blade including a hinge shaft attached to one of the first hole and the second hole to open and close the opening, and a motor provided to rotate the blade through the one of the first hole and the second hole, wherein the blade is connected to the first hole when rotated in a first direction and is connected to the second hole when rotated in a second direction opposite to the first direction.

The ventilation device may further include a dehumidifying flow path provided on the intake flow path and including a heat exchanger to remove moisture in the air flowing through the intake flow path, and the damper device may be positioned on the dehumidifying flow path.

The ventilation system may include a rotation guide provided between the motor and the hinge shaft to guide rotation of the blade.

The hinge shaft may include a first hinge shaft formed on an upper side of the blade and a second hinge shaft formed on a lower side thereof.

The rotation guide may include a motor coupling coupled to a motor shaft of the motor, and a hinge coupling extending integrally from the motor coupling and coupled to one of the first hinge shaft and the second hinge shaft.

The hinge coupling may further include a support surface having a D-cut shape, a portion of which is formed to be flat.

The one of the first hinge shaft and the second hinge shaft may further include a hinge groove corresponding to the support surface and having a D-cut shape.

The blade may further include a seal provided in close contact around the opening so as to maintain airtightness.

The one of the first bracket and the second bracket may further include a motor installation portion on which the motor is mounted.

The motor installation portion may further include a plurality of mounting holes formed near the first hole and the second hole.

According to various embodiments of the present disclosure, in the case of a pair of ventilation devices arranged bilaterally symmetrically, the configurations forming one ventilation device may be the same as the configurations of the other, thereby reducing manufacturing costs.

Further, according to various embodiments of the present disclosure, the damper device may be used in both directions by switching the assembly direction as required, thereby reducing costs.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
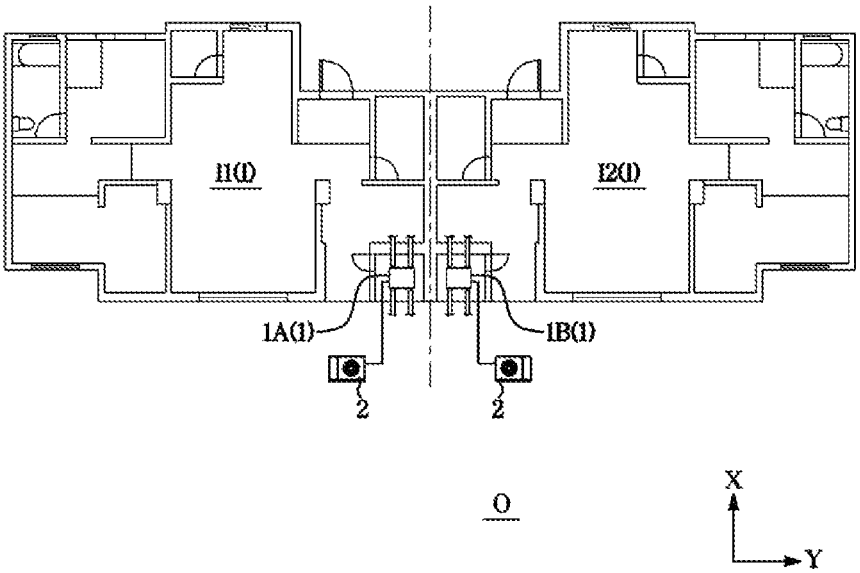
FIG. 1 is a view illustrating a ventilation system according to an embodiment of the present disclosure.

FIGS. 1 through 11, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described in the disclosure and configurations shown in the drawings are merely examples of the embodiments of the disclosure and may be used in various different ways at the time of filing of the present application to replace the embodiments and drawings of the disclosure.

In addition, the same reference numerals or signs shown in the drawings of the disclosure indicate elements or components performing substantially the same function. The shapes and sizes of elements in the drawings may be exaggerated for clarity.

Throughout the present specification, when a part is referred to as being "connected" to another part, it includes direct connections as well as indirect connections, and indirect connections include connections over a wireless communication network or through another part.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, figures, steps, operations, elements, components, or combinations thereof, but do not preclude the presence or addition of one or more of the features, figures, steps, operations, elements, components, or combinations thereof.

It will be understood that, although the terms "first", "second", "primary", "secondary", etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

As used herein, the terms "front", "rear", "upper", "lower", and the like are defined with reference to the drawings and are not intended to limit the shape and location of each component.

Hereinafter, various embodiments according to the disclosure will be described in detail with reference to the accompanying drawings.

Figure 2:
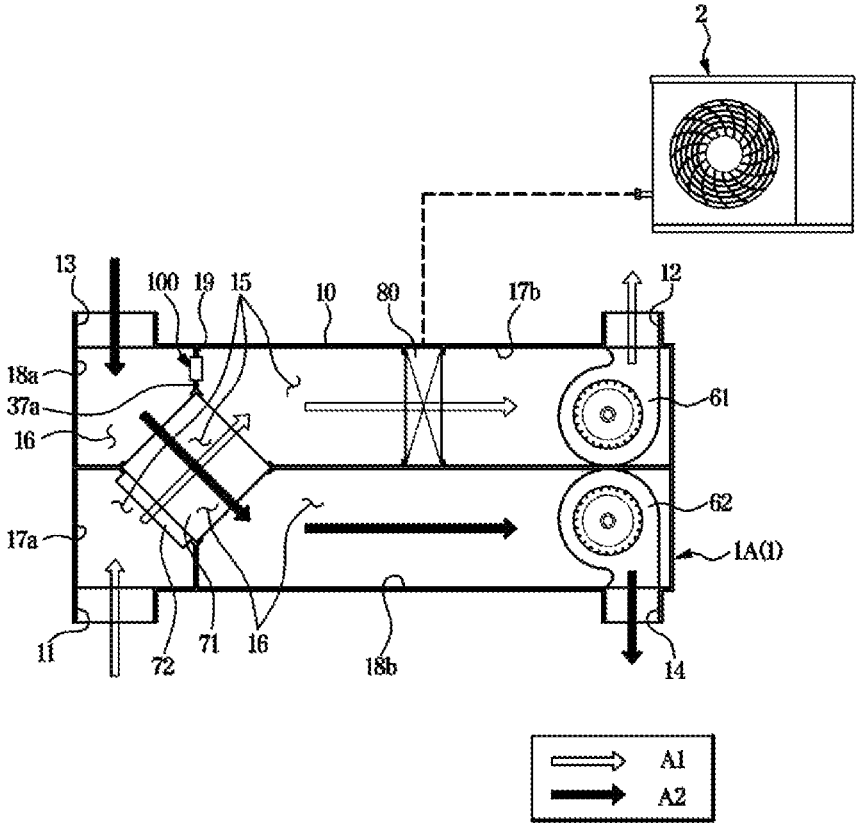
FIG. 2 is a schematic view illustrating an air flow of the ventilation system according to an embodiment of the present disclosure.
Figure 3:
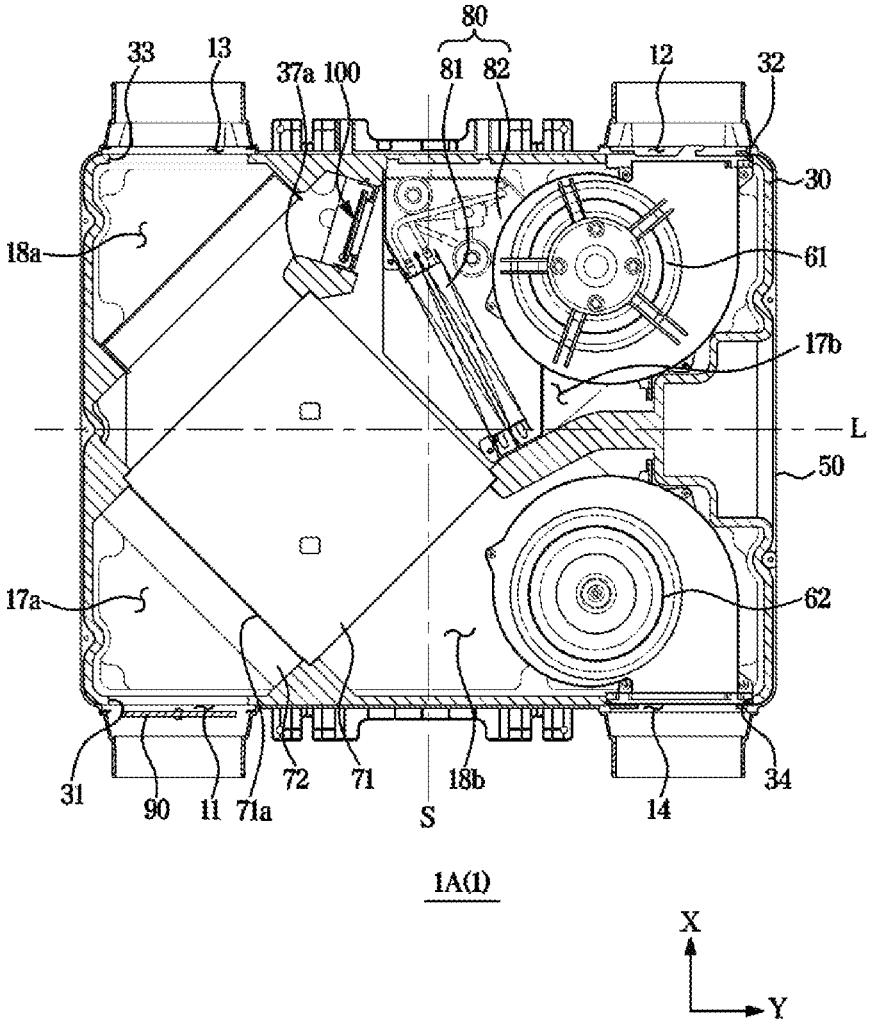
FIG. 3 is a top down view of the ventilation device shown in FIG. 1 with some components of a first type of ventilation device removed.

FIG. 1 is a view illustrating a ventilation system according to an embodiment of the present disclosure. FIG. 2 is a schematic view illustrating a flow of air of the ventilation system according to an embodiment of the present disclosure. FIG. 3 is a view of the ventilation device shown in FIG. 1 from top to bottom with some components of a first type of ventilation device removed.

Referring to FIGS. 1 to 3, the ventilation system may include a ventilation device 1 communicating with an indoor space I and an outdoor space O and exchanging indoor air and outdoor air, an outdoor unit 2 circulating a refrigerant supplied to the ventilation device.

In the drawings of the present disclosure, a configuration of the outdoor unit 2 is shown schematically and illustratively at a practicable level. Since the outdoor unit 2 corresponds to an outdoor unit for an air conditioner known in a conventional manner, a person skilled in the art may easily change or add various components necessary for implementing the outdoor unit 2. The outdoor unit 2 may be provided at a technical level that will be understood by a person skilled in the art based on the contents of this disclosure.

Conventional ventilation systems do not include the outdoor unit 2. Accordingly, in the conventional ventilation system, air is circulated between the indoor space I and the outdoor space O by the ventilation device 1, and heat exchange is performed between the air entering the indoor space I from the outdoor space O and the air exiting the indoor space I from the outdoor space O by a total heat exchanger 71 arranged in the ventilation device 1.

However, a ventilation system according to an embodiment of the present disclosure includes the outdoor unit 2 and the ventilation device 1 includes a heat exchanger 81 connected to the outdoor unit 2. Accordingly, the ventilation system according to the disclosure may be provided to heat exchange the air entering the indoor space I from the outdoor space O and the air exiting the indoor space I from the outdoor space O, and may further be provided to dehumidify the air supplied to the indoor space I. This will be described in more detail below.

The ventilation device 1 may include a housing 10 forming an exterior thereof. The housing 10 may be provided in a substantially box shape. The housing 10 may include an intake flow path 15 that intakes outdoor air into the indoor space, and an exhaust flow path 16 that exhausts indoor air to the outside. The intake flow path 15 and the exhaust flow path 16 may be partitioned from each other by the housing 10. The housing 10 may include a connecting flow path 19 that connects the intake flow path 15 and at least a portion of the exhaust flow path 16. The connecting flow path 19 may be provided to connect the intake flow path 15 and at least a portion of the exhaust flow path 16.

The housing 10 may include a first intake chamber 17*a* that is provided with a first inlet 11 communicating with the outdoor space O to allow outdoor air A1 to be drawn into the housing 10 and has the intake flow path 15 formed therein, and a second intake chamber 17*b* that is provided with a first outlet 12 communicating with the indoor space to allow the outdoor air A1 drawn into the housing 10 to be discharged to the indoor space I and has the intake flow path 15 formed therein.

The housing 10 may include a first exhaust chamber 18*a* that is provided with a second inlet 13 communicating with the indoor space I to allow indoor air A2 to be drawn into the housing 10 and has the exhaust flow path 16 formed therein, and a second exhaust chamber 18*b* that is provided with a second outlet 14 communicating with the outdoor space O to allow the indoor air A2 drawn into the housing 10 to be discharged to the outside and has the exhaust flow path 16 formed therein. The exhaust flow path 16 may connect the second inlet 13 and the second outlet 14.

The ventilation device 1 may include a first blowing fan 61 disposed inside the second intake chamber 17*b*, generating a blowing force necessary to draw the outdoor air A1 into the interior, and communicating with the first outlet 12. The ventilation device 1 may include a second blowing fan 62 disposed inside the second exhaust chamber 18*b*, generating a blowing force necessary to exhaust the indoor air A2 to the outside, and communicating with the second outlet 14.

The ventilation device 1 may include the total heat exchanger 71 in which the air flowing through the exhaust flow path 16 and the air flowing through the intake flow path 15 exchange heat with each other. The total heat exchanger 71 may include a plate type total heat exchanger or a rotary type total heat exchanger. The total heat exchanger 71 may be disposed at a point where the intake flow path 15 and the exhaust flow path 16 intersect. In other words, the total heat exchanger 71 may be disposed on the intake flow path 15 and on the exhaust flow path 16 at the same time.

The total heat exchanger 71 may allow the first intake chamber 17*a* to communicate with the second intake chamber 17*b*, or vice versa. The total heat exchanger 71 may allow the first exhaust chamber 18*a* to communicate with the second exhaust chamber 18*b*, or vice versa.

The ventilation device 1 may include a filter 72 provided to remove foreign substances flowing on the outdoor air A1.

The filter 72 may be provided to collect foreign substances of a certain size. The filter 72 may include a high efficiency particulate air (HEPA) filter to collect fine dust of a certain size. HEPA filters may be formed from glass fibers. However, the filter 72 is not limited thereto and may be provided as various types of filters for collecting foreign substances.

Furthermore, the filter 72 may be not limited thereto and may be provided as a photocatalyst filter that induces a chemical action in air using a photocatalyst. In other words, the filter 72 may include a photocatalyst and may sterilize various pathogens and bacteria present in the air by inducing a chemical reaction using the light energy of the photocatalyst. By promoting the chemical action, odor particles in the air may be decomposed, removed, or collected.

In addition, although not shown in the drawings, a prefilter may be additionally provided to collect foreign substances of a certain size or larger in the air. The filter 72 may be placed adjacent to the total heat exchanger 71. Foreign substances flowing on the outdoor air A1 entering through the first inlet 11 may be collected by the filter 72 before the outdoor air A1 flows into the total heat exchanger 71, thereby preventing the total heat exchanger 71 from being contaminated.

The ventilation device 1 may include a dehumidifying device 80 provided to regulate the humidity of the air flowing through the intake flow path 15.

The dehumidifying device 80 may control the humidity of the outdoor air A1 flowing through the intake flow path 15 and may additionally control the temperature.

The dehumidifying device 80 may include a heat exchanger 81 provided to exchange heat with the outdoor air A1 flowing inside the intake flow path 15, and a drain tray 82 provided to collect condensed water generated from the heat exchanger 81.

The heat exchanger 81 may be provided as a pair of heat exchangers. Each of the pair of heat exchangers 81 may exchange heat with the outdoor air A1. The pair of heat exchangers 81 may be operated in a mode in which both heat exchangers become evaporators, or in a mode in which one heat exchanger becomes an evaporator and the other heat exchanger becomes a condenser.

As described above, the heat exchanger 81 may be operated in multiple modes and selectively arranged to dehumidify the outdoor air A1 while maintaining the temperature of the outdoor air A1, or to dehumidify the outdoor air A1 while cooling the outdoor air A1. However, the heat exchanger 81 is not limited thereto and may be provided as a single heat exchanger to mainly dehumidify the outdoor air A1.

The dehumidifying device 80 may be provided on the intake flow path 15. The dehumidifying device 80 may be disposed inside the second intake chamber 17*b*. In other words, the dehumidifying device 80 may be disposed on a downstream side of the intake flow path 15 than the total heat exchanger 71.

As described above, during operation of the heat exchanger 81 in different modes, in order to selectively dehumidify the indoor air A2 or dehumidify and cool the indoor air A2 to allow the dehumidified air to flow into the indoor space, a damper device 100 may be provided.

The damper device 100 may be arranged on the connecting flow path 19 that connects the intake flow path 15 and at least a portion of the exhaust flow path 16. In particular, the connecting flow path 19 may be arranged between the first exhaust chamber 18*a* and the second intake chamber 17*b* and be located on a partition wall 37*a* partitioning the first exhaust chamber 18*a* and the second intake chamber 17*b*. The damper device 100 will be described in detail later.

The housing 10 may include a first housing 30 and a second housing 20 coupled to the first housing 30 in a vertical direction Z.

The ventilation device 1 may include covers 40 and 50 provided to cover the housing 10. The covers 40 and 50 may be provided to form the exterior of the ventilation device 1.

The covers 40 and 50 may include the first cover 50 disposed at a lower portion in the vertical direction Z, and the second cover 40 disposed at an upper portion of the first cover 50 in the vertical direction Z and coupled to the first cover 50 in the vertical direction Z.

The housing 10 may be made of an insulating material. The housing 10 may preferably be made of expanded polystyrene (EPS) insulating material, such as Styrofoam. However, the housing 10 is not limited thereto and may be formed from various insulating materials provided that the temperature of the air flowing through the intake flow path 15 and the exhaust flow path 16 is maintained at a constant temperature.

The covers 40 and 50 may be provided to cover the housing 10 made of an insulating material to protect the housing 10 from the outside. The covers 40 and 50 may be formed from an injection molded material, such as plastic.

In an embodiment of the present disclosure, the configuration names of the housing 10 and the covers 40 and 50 are given, but the housing 10 may be referred to as the insulation material and the covers 40 and 50 may be referred to as the housings 40 and 50. However, hereinafter, the housing 10 and the covers 40 and 50 will be described using the above configuration names.

The ventilation device 1 of the ventilation system may be placed inside the indoor space I to introduce the outdoor air A1 into the indoor space I and to discharge the indoor air A2 to the outside space O, thereby ventilating the indoor space I. Also, it may circulate the indoor air A2.

When the ventilation device 1 is installed in the indoor space I, such as a multi-family house or an apartment, the indoor space I may be provided as a pair of indoor spaces I1 and I2 arranged symmetrically, as shown in FIG. 1.

The pair of indoor spaces I1 and I2 may be formed mirror symmetrically in a left-right direction Y based on a direction in which the outdoor air A1 is exhausted to the indoor space I.

Accordingly, air conditioners formed in each of the indoor spaces I1 and I2 may also be arranged to be formed symmetrically in the left-right direction Y. At this time, when the ventilation devices 1 of the same shape are arranged in each of the indoor spaces I1 and I2, it may be unavailable to install the ventilation devices 1 in the indoor spaces I1 and I2 because the first and second inlets 11 and 13 and the first and second outlets 12 and 14 are arranged opposite to each other in the left-right direction Y.

For this reason, in a conventional ventilation device, upper and lower surfaces of the housing are inverted in the left-right direction Y to allow the ventilation devices to be installed in each of the pair of indoor spaces I1 and I2.

However, in an embodiment of the present disclosure, as described above, the ventilation device 1 may include the dehumidifying device 80, which provides not only simple ventilation of the indoor space I but also dehumidification of the indoor space I. At this time, a user needs to periodically withdraw the drain tray 82, which collects condensed water generated from the dehumidifying device 80, from the ventilation device 1 for cleaning.

In addition, the user needs to remove the total heat exchanger 71 and the filter 72 from the ventilation device 1 to periodically clean foreign substances collected in the total heat exchanger 71 and the filter 72.

The ventilation device 1 may be provided with removal holes in the housing 10 and the covers 40 and 50, respectively, through which the drain tray 82, the total heat exchanger 71, and the filter 72 are arranged to be ejected. Accordingly, the drain tray 82, the total heat exchanger 71, and the filter 72 may be removed through the removal holes.

At this time, if the ventilation device 1 is installed by simply inverting the upper and lower surfaces of the housing in the left-right direction Y, it is difficult to remove the drain tray 82, the total heat exchanger 71, and the filter 72.

In other words, when the ventilation device 1 is turned over in the left-right direction Y, the positions of the drain tray 82, the total heat exchanger 71, and the filter 72 are inverted in the vertical direction Z, so that the positions of the drain tray 82, the total heat exchanger 71, and the filter 72 do not correspond to the positions of the removal holes formed in the ventilation device 1 in the vertical direction Z. As a result, the drain tray 82, the total heat exchanger 71, and the filter 72 may not be removed.

In order to avoid such a situation, a pair of ventilation devices 1 is manufactured with a type corresponding to each of the indoor spaces I1 and I2 or air conditioning equipment is formed differently corresponding to each of the indoor spaces I1 and I2. However, this may increase the manufacturing cost or cause the ventilation device 1 to be inefficiently installed in the indoor space I.

In the case of the conventional ventilation device, the dehumidifying device 80 is not included therein. Accordingly, it is no problem to install the ventilation device 1 by turning the ventilation device 1 upside down in the left-right direction Y regardless of removing of the drain tray 82.

In addition, in the case of the conventional ventilation device, the total heat exchanger 71 and the filter 72 may be removable from the ventilation device 1. In the case of a conventional ventilation device, the total heat exchanger 71 and the filter 72 are arranged so as to be symmetrically in the left-right direction Y or a front-back direction X about either a long central axis L extending parallel to a long side of the housing 10 or a short central axis S extending parallel to a short side of the housing 10, respectively, based on the long central axis L or the short central axis S.

However, in contrast to an embodiment of the present disclosure, the short side of the housing 10 is arranged to extend in the left-right direction Y and the long side thereof is arranged to extend in the front-back direction X. As a result, the long central axis L and the short central axis S may also extend differently.

In addition, in the case of the conventional ventilation device, the removal holes corresponding to the upper portion and lower portion in the vertical direction are also formed in the housing 10 and the covers 40 and 50 such that the total heat exchanger 71 and the filter 72 may be removed from the ventilation device in both directions with respect to the vertical direction Z.

Accordingly, in the case of the conventional ventilation device, when the ventilation device 1 is installed by turning it over in the left-right direction Y, the total heat exchanger 71 and the filter 72 may be removed from the ventilation device 1 in either of the vertical directions Z through the removal hole formed at the upper portion or the removal hole formed at the lower portion.

However, in the case of the ventilation device 1 according to an embodiment of the present disclosure, the dehumidifying device 80 may be arranged inside the housing 10. As a result, it is difficult for the dehumidifying device 80, in addition to the total heat exchanger 71 and the filter 72, to be disposed symmetrically about any one of the central axes L and S.

In other words, because both the dehumidifying device 80, the total heat exchanger 71, and the filter 72 need to be placed in the housing 10, when each of them is arranged in the left-right direction Y or the front-back direction X based on any one of the central axes L and S, the size of the ventilation device 1 may become too large for a conventional ventilation device, making it difficult to install the ventilation device 1 in the indoor space I. Furthermore, as the ventilation device 1 becomes larger, the area of the intake and exhaust flaw paths 15 and 16 formed therein becomes larger, which may lead to a decrease in efficiency.

To avoid such a situation, in the ventilation device 1 according to the present disclosure, the first housing 30 may form one surface 36 of the housing 10, and include a first hole 35 formed asymmetrically on the one surface 36 relative to central axes L and S of the one surface 36 extending in a longitudinal or transverse direction of the one surface 36 and provided so that the drain tray 82, the total heat exchanger 71, and the filter 72 are removable from the housing 10.

In addition, the second housing 20 may form the other side of the housing (not shown), and include a second hole (not shown) disposed on the other side thereof and formed in a shape corresponding to the first hole 35 in the vertical direction Z.

One of the first housing 30 and the second housing 20 may be selectively covered by the first cover 50, and the other one of the first housing 30 and the second housing 20 may be selectively covered by the first cover 50.

In other words, the first cover 50 and the second cover 40 may be arranged to fixedly form a lower portion and an upper portion of the ventilation device 1, respectively, and one of the first housing 30 and the second housing 20 may be selectively provided to be inserted into the first cover 50 forming the lower portion of the ventilation device 1, and the other of the first housing 30 and the second housing 20 may be selectively inserted into the second cover 40.

Accordingly, the first housing 30 may be inserted into the first cover 50 and be located on the lower portion of the ventilation device 1, and in some cases, the second housing 20 may be inserted into the first cover 50 and be located on the lower portion of the ventilation device 1.

Assuming that the ventilation device 1 disposed on the left in the left-right direction Y based on FIG. 1 is defined as a first type 1A and the ventilation device 1 disposed on the right is defined as a second type 1B, the ventilation device 1 according to an embodiment of the present disclosure may implement both the ventilation device of the first type 1A and the ventilation device of the second type 1B types by changing the positions of the first housing 30 and the second housing 20 in the vertical direction Z.

In the case of the first type of ventilation device 1A, the first housing 30 may form the lower portion of the housing 10 in the vertical direction Z and may be provided to be inserted into the first cover 50. Consequently, the second housing 20 may be provided to arrange on the upper portion of the first housing 30 in the vertical direction Z.

The internal components of the housing 10, such as the blowing fans 61 and 62, the dehumidifying device 80, the total heat exchanger 71, and the filter 72, may be mounted based on the internal shape of the first housing 30. The drain tray 82, the total heat exchanger 71, and the filter 72 may be arranged to correspond to the first hole 35 of the first housing 30.

In the case of the second type of ventilation device 1B described later, the second housing 20 may form the lower portion of the housing 10 in the vertical direction Z and may be provided to be inserted into the first cover 50. Consequently, the first housing 30 may be provided to arrange on the upper portion of the second housing 20 in the vertical direction Z (see FIG. 11).

The internal components of the housing 10, such as the blowing fans 61 and 62, the dehumidifying device 80, the total heat exchanger 71, and the filter 72, may be mounted based on the internal shape of the second housing 20. The drain tray 82, the total heat exchanger 71, and the filter 72 may be arranged to correspond to a second hole of the second housing 20.

In other words, the first and second types of ventilation devices 1A and 1B may be formed by simply changing the positions of the first and second housings 30 and 20 in the vertical direction Z. Hereinafter, the description will be based on the first type of ventilation device 1A.

Figure 4:
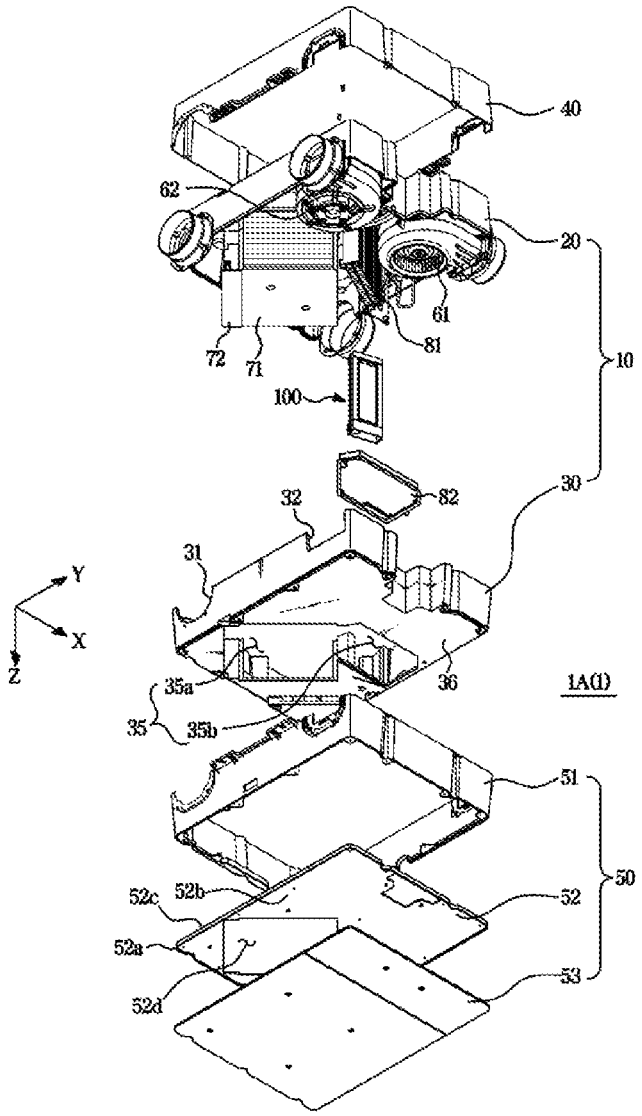
FIG. 4 is an exploded perspective view of the first type of ventilation device shown in FIG. 1.
Figure 5:
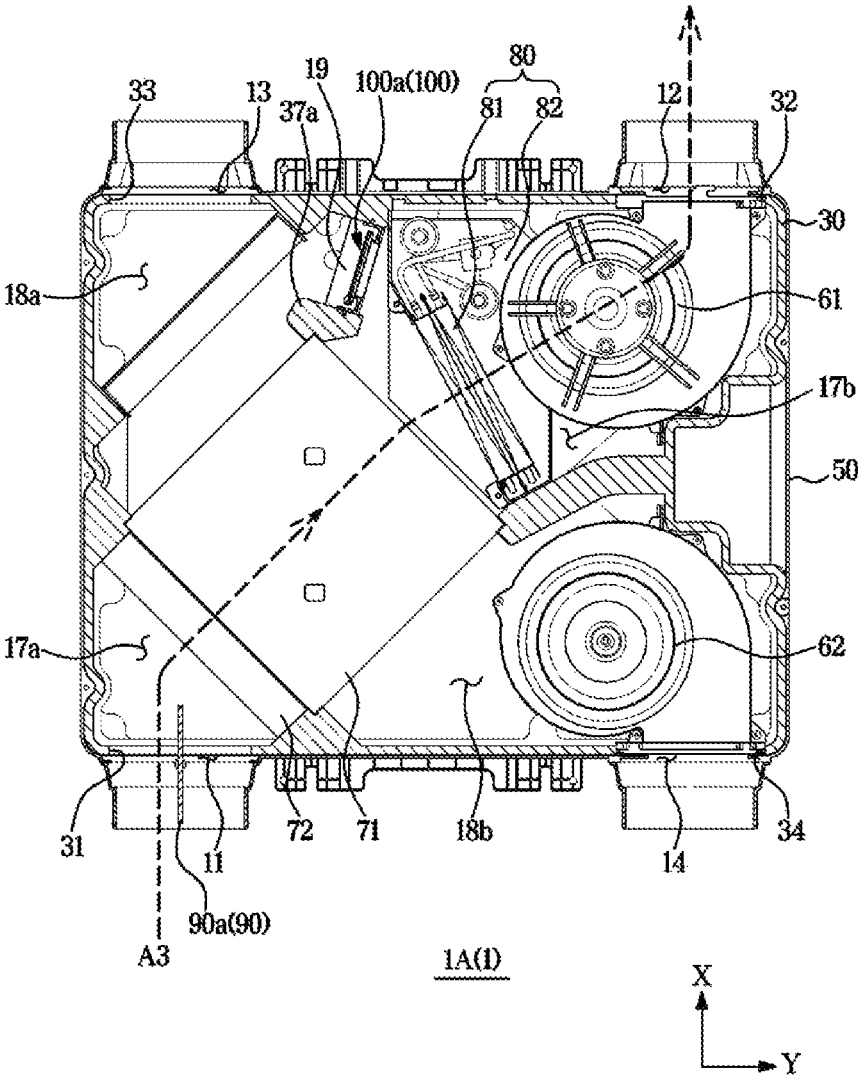
FIGS. 5 and 6 are schematic views illustrating the flow of air in the first type of ventilation device shown in FIG. 1.
Figure 6:
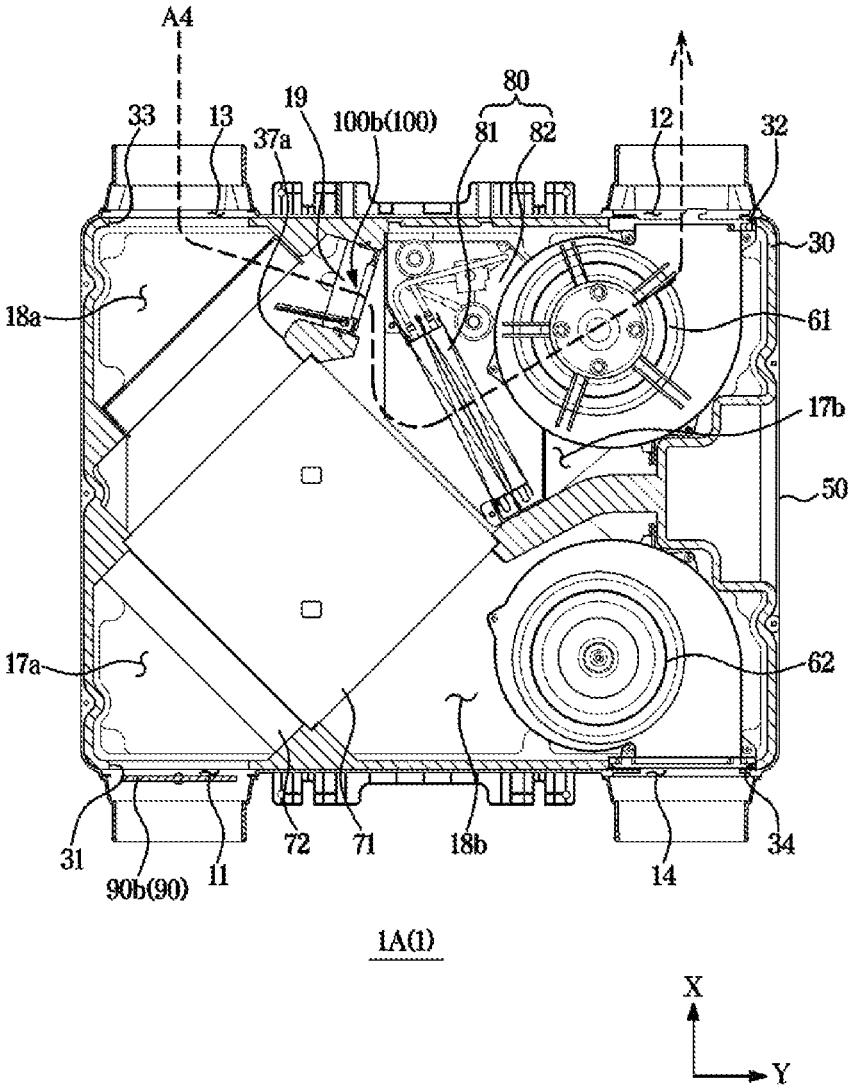

FIG. 4 is an exploded perspective view of the first type of ventilation device shown in FIG. 1. FIGS. 5 and 6 are schematic views illustrating a flow of air in the first type of ventilation device shown in FIG. 1. Duplicate parts of the above descriptions may be omitted.

As shown in FIGS. 4 to 6, the ventilation device 1 may be arranged in the order of the second cover 40 forming the upper portion of the ventilation device 1, the second housing 20 provided to be inserted into the second cover 40, the first housing 30 coupled to the second housing 20 at the lower portion in the vertical direction Z, and the first cover 50 forming the lower portion of the ventilation device 1 and covering the first housing 30.

The internal components of the housing 10, such as the blowing fans 61 and 62, the dehumidifying device 80, the total heat exchanger 71, the filter 72, and the damper device 100, may be provided to be supported by the first housing 30 or the second housing 20. However, the drain tray 82, the total heat exchanger 71, and the filter 72 may be supported so as to be removable downwardly from the ventilation device 1 through the first hole 35 of the first housing 30.

As described above, the first and second housings 30 and 20 may be assembled by changing their positions in the vertical direction Z, but the first and second covers 50 and 40 may be placed in the same position during assembly, regardless of the type of the ventilation device 1. The second cover 40 may always form the upper portion of the ventilation device 1 and the first cover 50 may always form the lower portion of the ventilation device 1.

The first cover 50 may include a body portion 51 having a square frame shape, a face portion 52 detachably coupled to the body portion 51 and provided in a plate shape, and a lower cover portion 53 provided to cover the face portion 52 from a lower portion thereof.

The first cover 50 may be provided to communicate with the housing 10 because, in contrast to the second cover 40, the drain tray 82, the total heat exchanger 71, and the filter 72 need be withdrawn to the outside of the ventilation device 1.

In particular, the face portion 52 may include a third hole 52*d* provided to correspond to the first hole 35 of the first housing 30.

The face portion 52 may include a plate body 52*a*, a first surface 52*b* of the plate body 52*a*, and a second surface 52*c* disposed opposite the first surface 52*b*.

The third hole 52*d* may be disposed on the plate body 52*a*. As described above, the third hole 52*d* may be provided to correspond to the first hole 35, i.e., to be asymmetrically disposed on the plate body 52*a* about one of the long and short central axes L and S of the housing 10.

In the first type of ventilation device 1, the face portion 52 may be coupled to the body portion 51 such that the first surface 52*b* is directed downward. When the first surface 52*b* is coupled to the body portion 51 so as to face downward, the third hole 52*d* may be provided to correspond to the first hole 35 of the first housing 30 in the vertical direction Z.

The first hole 35 and the third hole 52*d* may have substantially the same shape and may be aligned to be stacked in the vertical direction Z.

Conversely, the face portion 52 may be coupled to the body portion 51 such that the second surface 52*c* is directed downward. At this time, since the face portion 52 is inverted, the third hole 52*d* may be arranged in a shape inverted when coupled to the body portion 51 such that the first surface 52*b* faces downward.

When the lower cover portion 53 is removed from the first cover 50, the drain tray 82, the total heat exchanger 71, and the filter 72 may be exposed to the outside downwardly of the ventilation device 1.

The user may remove the drain tray 82, the total heat exchanger 71, and the filter 72 downward from the ventilation device 1 as needed.

The outer structures of the first housing 30 and the second housing 20 may be provided the same. As described above, since the first housing 30 or the second housing 20 may be provided to be selectively inserted into the first cover 50, the outer shapes of each of the housings 20 and 30 are required to be the same so that the first housing 30 or the second housing 20 may be selectively inserted into the first cover 50. As a result, both the first housing 30 and the second housing 20 may be inserted into and supported by the cover 50.

Conversely, the first housing 30 or the second housing 20 may be provided to be selectively inserted into the second cover 40. In this case, the outer shape of each of the housings 20 and 30 are required be the same to ensure that the second cover 40 may be inserted and supported in the same manner.

The first housing 30 may include a first inlet forming portion 31 that forms a portion of the first inlet 11, a first outlet forming portion 32 that forms a portion of the first outlet 12, a second inlet forming portion 33 that forms a portion of the second inlet 13, and a second outlet forming portion 34 that forms a portion of the second outlet 14.

The first outlet forming portion 32 and the second outlet forming portion 34 may be provided to be symmetrical with respect to the long central axis L. Furthermore, the first inlet forming portion 31 and the second inlet forming portion 33 may be provided to be symmetrical with respect to the long central axis L.

This is so that the first housing 30 maintains the same shape even when the first housing 30 is disposed inverted in the left-right direction Y.

For example, when provided as the first type of ventilation device 1A, the first outlet forming portion 32 may be disposed on the right side of the ventilation device 1 in the left-right direction Y. and when provided as the second type of ventilation device 1B, the first outlet forming portion 32 may be disposed on the left side of the ventilation device 1 in the left-right direction Y.

Likewise, the second housing 20 may include a first inlet forming portion 21 that forms a portion of the first inlet 11, a first outlet forming portion 22 that forms a portion of the first outlet 12, a second inlet forming portion 23 that forms a portion of the second inlet 13, and a second outlet forming portion 24 that forms a portion of the second outlet 14.

The first outlet forming portion 22 and the second outlet forming portion 24 may be provided to be symmetrical with respect to the long central axis L. Furthermore, the first inlet forming portion 21 and the second inlet forming portion 23 may be provided to be symmetrical with respect to the long central axis L.

Each of the first outlet forming portion 32 of the first housing 30 and the first outlet forming portion 22 of the second housing 20, the first inlet forming portion 31 of the first housing 30 and the first inlet forming portion 21 of the second housing 20, the second outlet forming portion 34 of the first housing 30 and the second outlet forming portion 24 of the second housing 20, and the second inlet forming portion 33 of the first housing 30 and the second inlet forming portion 23 of the second housing 20 may be formed to correspond to each other in the vertical direction Z.

This is so that the first and second outlets 12 and 14 and the first and second inlets 11 and 13 may be provided to become in the same shape even when the first housing 30 and the second housing 20 are assembled by turning them upside down in the vertical direction Z.

Each of the first housing 30 and the second housing 20 may include a partition provided to partition the first and second intake chambers 17*a* and 17*b* and the first and second exhaust chambers 18*a* and 18*b* within the housing 10.

Each partition may be arranged to correspond to the vertical direction Z.

As described above, the dehumidifying device 80 may be disposed in the second intake chamber 17*b*. Accordingly, the second intake chamber 17*b* may be provided to have a size larger than that of the first intake chamber 17*a* and the first and second exhaust chambers 18*a* and 18*b*.

The first and second intake chambers 17*a* and 17*b* and the first and second exhaust chambers 18*a* and 18*b* may be formed by one surface 36 of the housing 10 formed on the first housing 30, the other surface of the housing 10 formed on the second housing 20, and a space partitioned by the partitions of each housing 20 and 30, and each of the first and second intake chambers 17*a* and 17*b* and the first and second exhaust chambers 18*a* and 18*b* may communicated by the total heat exchanger 71.

The total heat exchanger 71 may be provided in a square shape. This is to ensure that the outdoor air A1 and indoor air A2 flowing in the total heat exchanger 71 may exchange heat in the same amount.

The first hole 35 in which the total heat exchanger 71, the filter 72, and the drain tray 82 are provided to be removable may be divided into a first region 35*a* in which the total heat exchanger 71 and the filter 72 are removable, and a second region 35*b* in which the drain tray 82 is removable.

According to an embodiment of the present disclosure, the first region 35*a* and the second region 35*b* may be provided in a shape connected to each other but are not limited thereto. The first region 35*a* and the second region 35*b* may be arranged to be separated from each other.

The first region 35*a* may be provided in a substantially rectangular shape. As described above, it is such that the total heat exchanger 71 is provided to have a square cross-section and the filter 72 is located adjacent to an intake inlet end of the total heat exchanger 71.

Accordingly in order for both the total heat exchanger 71 and the filter 72 to be exposed to the outside, the first region 35*a* may be provided in the rectangular shape.

The second region 35*b* may be provided in a shape corresponding to the cross section of the drain tray 82. The cross-sectional shape of the second region 35*b* is not limited to one shape and may be formed in different ways.

When a first side on which the first inlet 11 and the second outlet 14 are disposed in the front-back direction X is defined as one side, and a second side on which the second inlet 13 and the first outlet 12 are disposed is defined as the other side, the total heat exchanger 71 may be disposed adjacent to one side of the housing 10 about the long central axis L. In particular, the total heat exchanger 71 may be disposed closest to the first inlet 11.

This is to maximize the area of the second exhaust chamber 18*b* in the limited internal space of the housing 10 as the dehumidifying device 80 needs to be disposed adjacent to the first outlet 12.

Accordingly, the first region 35*a* of the first hole 35 in the first housing 30 may be most disposed adjacent to the first outlet forming portion 32 of the first housing 30 about the long central axis L so as to correspond to the total heat exchanger 71.

As a result, the first hole 35 may be formed asymmetrically at the center on one surface 36 of the first housing 30 about the long central axis L or short central axis S.

Assuming that one surface 36 of the first housing 30 and the other surface of the second housing 20 are arranged parallel to the long central axis L or the short central axis S on the same surface, the first hole 35 of the first housing 30 and the second hole of the second housing 20 may be provided in a mirror symmetrical shape about the center axis between the first housing 30 and the second housing 20.

Furthermore, the partition of the first housing 30 and the partition of the second housing 20 may also be provided in a mirror symmetrical shape about the center axis between the first housing 30 and the second housing 20.

As a result, when the first housing 30 and the second housing 20 are inverted in the vertical direction Z to form the ventilation device 1, the first type of ventilation device 1A and the second type of ventilation device 1A may be arranged symmetrically in the left-right direction Y.

As shown in FIGS. 5 and 6, the housing 10 may include the connecting flow path 19 that connects the intake flow path 15 and at least a portion of the exhaust flow path 16.

The connecting flow path 19 may be disposed between the first exhaust chamber 18*a* and the second intake chamber 17*b* and be disposed on the partition wall 37*a* dividing the first exhaust chamber 18*a* and the second intake chamber 17*b*.

Figure 11:
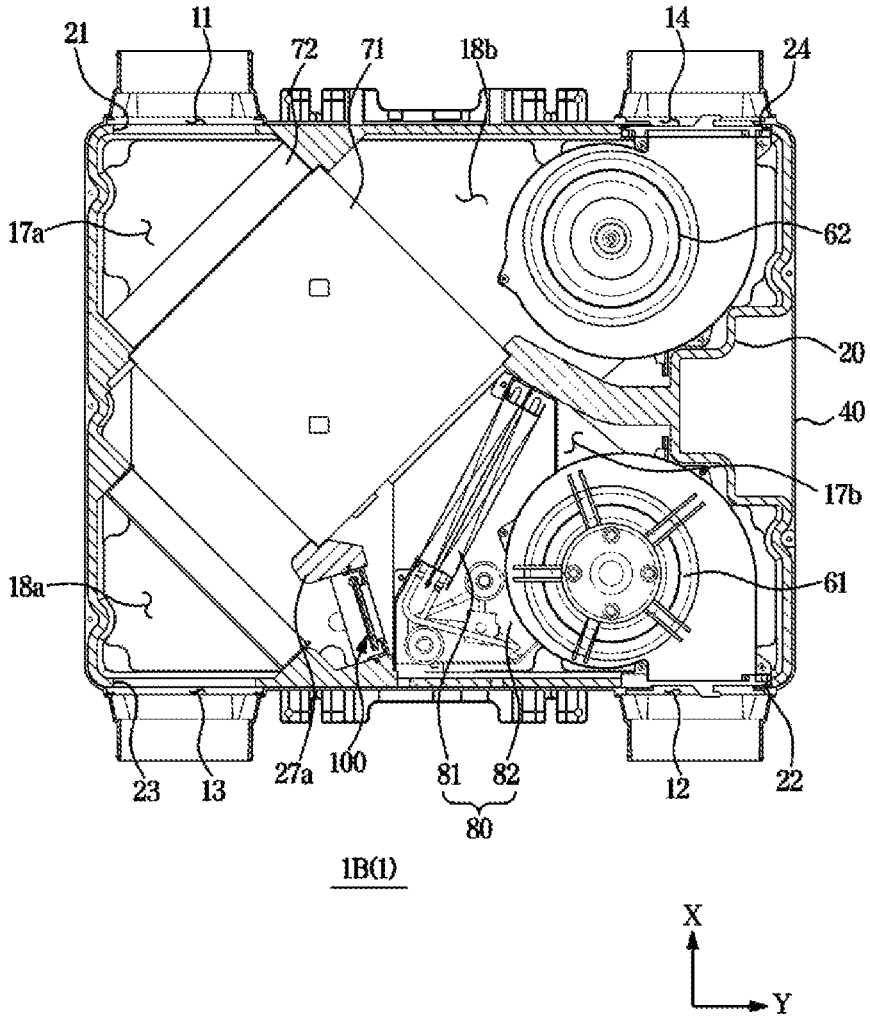
FIG. 11 is a view illustrating a second type of ventilation device equipped with the damper device having the blade rotating in the second direction shown in FIG. 9.

The partition wall 37*a* may be formed by a partition wall forming portion 27*a* of the first housing 30 and a partition wall forming portion 27*a* of the second housing 20 (see FIG. 11). The connecting flow path 19 may be formed by cutting at least a portion of the partition wall 37*a*. Accordingly, the first exhaust chamber 18*a* and the second intake chamber 17*b* may be provided to communicate with each other.

The ventilation device 1 may include the damper device 100 disposed on the connecting flow path 19 and provided to open and close the connecting flow path 19.

The damper device 100 may be provided to selectively open and close the connecting flow path 19 so that the first exhaust chamber 18*a* and the second intake chamber 17*b* may be selectively communicated.

Furthermore, the ventilation device 1 may include a first inlet opening/closing unit 90 disposed on the first inlet 11 and selectively opening and closing the first inlet 11.

Hereinafter, an operation of the ventilation device 1 according to an embodiment of the present disclosure will be described.

The ventilation device 1 may include a controller (not shown) configured to control the ventilation device 1 based on the indoor temperature and/or the indoor humidity and/or the outlet temperature, and to control an operating mode of the ventilation device 1 based on a user selection.

The controller (not shown) may be electrically connected, either wired or wirelessly, with a temperature sensor for detecting the temperature of the indoor space I and the outdoor space O and an outlet temperature sensor (not shown) for detecting the temperature of the air discharged from the ventilation device 1, to receive the detected value from each sensor.

The ventilation device 1 may be operated in a cooling dehumidification mode, an outdoor dehumidification mode, and an indoor dehumidification mode. The ventilation device 1 may be operated in an operating mode automatically selected by the controller (not shown) based on the values detected by each sensor, or may be operated in an operating mode selected by the user.

The cooling dehumidification mode may adjust an amount of refrigerant delivered to the dehumidifying device 80 to remove moisture in the air introduced from the outdoor space O while absorbing heat, thereby providing cooled air to the indoor space I.

The outdoor dehumidification mode may remove moisture in the air introduced from the outdoor space O while maintaining the temperature of the air introduced into the ventilation device 1, thereby providing cooled air to the indoor space I.

The indoor dehumidification mode may remove moisture in the air introduced from the indoor space I while circulating the air in the indoor space I through the ventilation device 1, thereby providing cooled air back to the indoor space I.

In the outdoor dehumidification mode, as shown in FIG. 5, an external air A3 introduced into the ventilation device 1 through the first inlet 11 may be arranged to be heat exchanged through the total heat exchanger 71 and then provided to the indoor space I by way of the dehumidifying device 80 and through the first outlet 12.

At this time, the damper device 100 may be provided in a closed state 100*a* to prevent the air introduced from the room from mixing with the external air A3.

In addition, the first inlet opening/closing unit 90 may be provided in an open state 90*a* to allow the external air A3 to flow into the ventilation device 1.

In the indoor dehumidification mode, as shown in FIG. 6, an internal air A4 introduced into the ventilation device 1 through the second inlet 13 is not allowed to flow to the second outlet 14 through the total heat exchanger 71, and is allowed to flow into the second intake chamber 17*b* through the connecting flow path 19, leading to be circulated to the indoor space I by way of the dehumidifying device 80 and through the first outlet 12.

At this time, the damper device 100 may be in an open state 100*b* to allow the internal air A4 introduced from the room to flow into the connecting flow path 19.

In addition, the first inlet opening/closing unit 90 may be provided in a closed state 90*b* to prevent the outside air from flowing into the ventilation device 1 and mixing with the internal air A4.

Accordingly, the ventilation device 1 may be operated by selecting the operating mode, either the outdoor dehumidification mode in which the external air A3 is introduced into the indoor space I or the indoor dehumidification mode in which the internal air A4 is circulated into the indoor space I.

Figure 7:
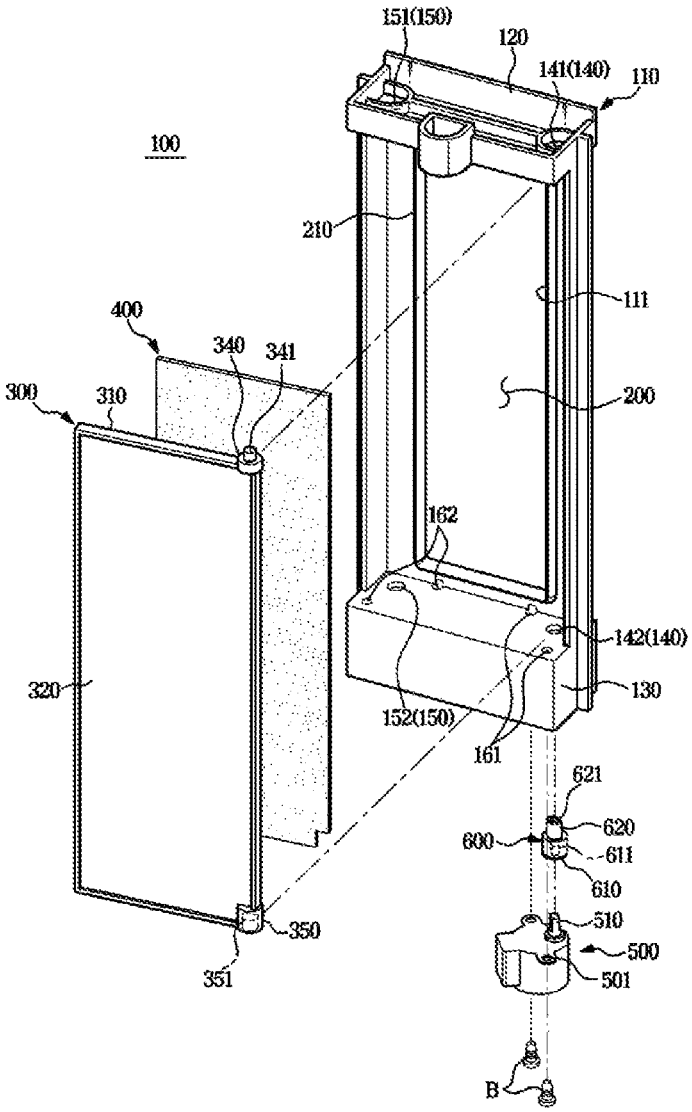
FIG. 7 is an exploded perspective view illustrating a damper device of the ventilation device shown in FIG. 1.
Figure 8:
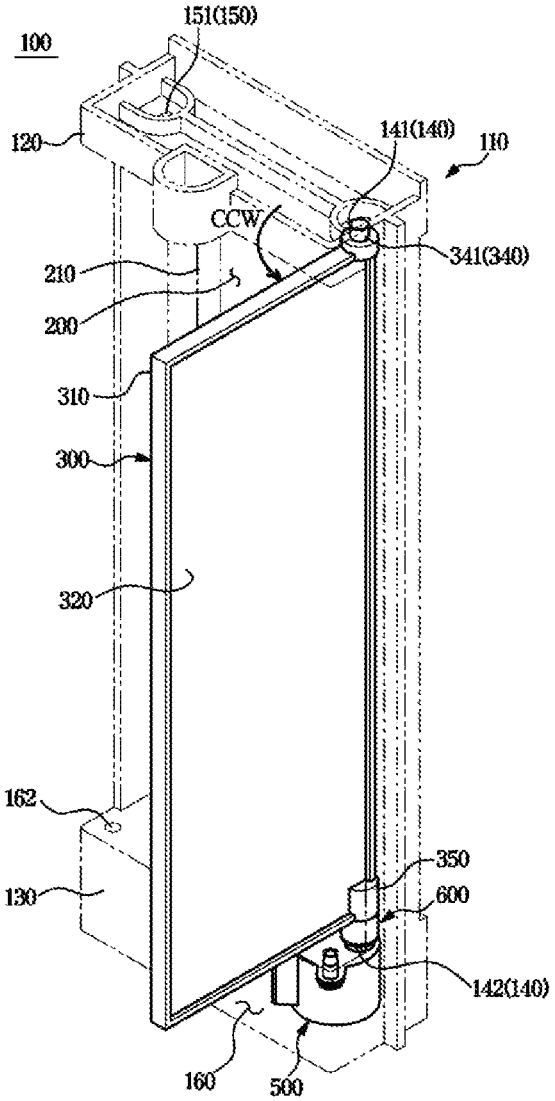
FIG. 8 is a view illustrating the damper device having a blade rotating in a first direction according to an embodiment of the present disclosure.
Figure 9:
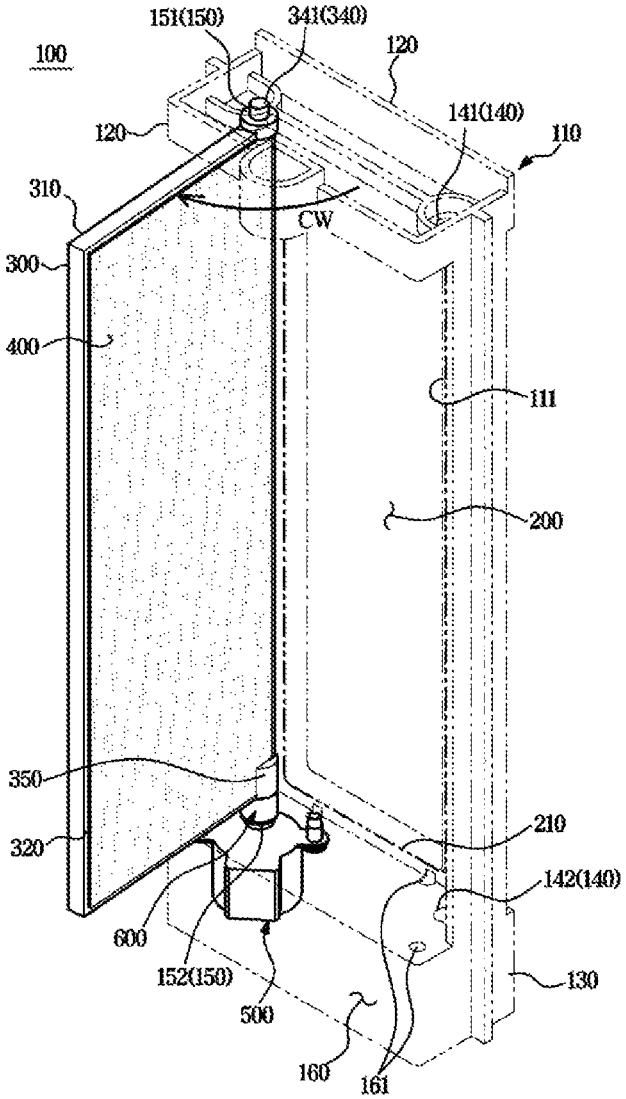
FIG. 9 is a view illustrating the damper device having the blade rotating in a second direction according to an embodiment of the present disclosure.
Figure 10:
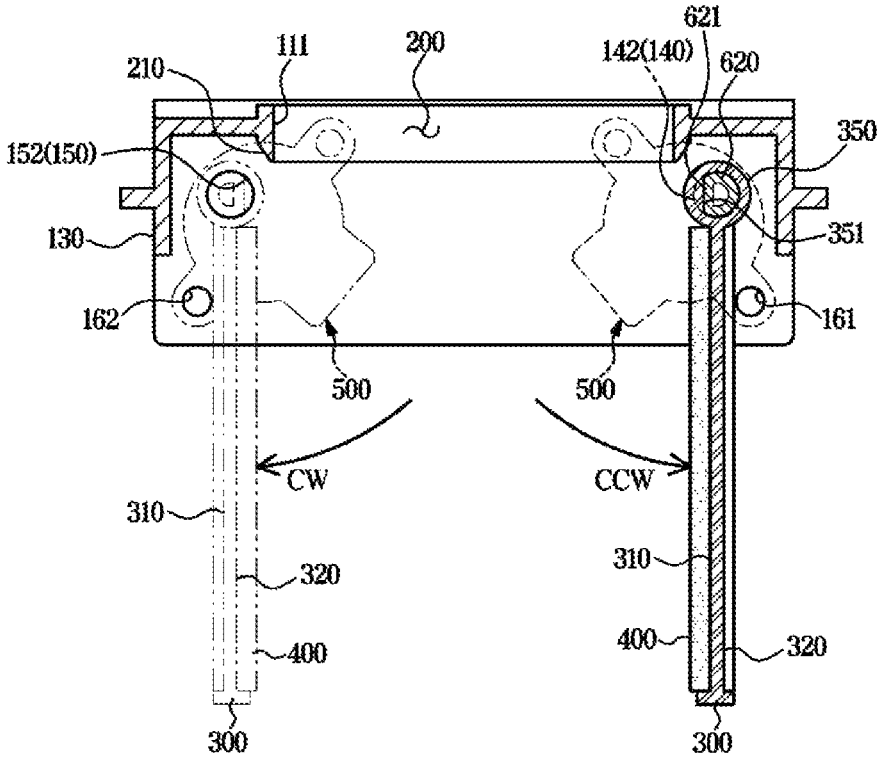
FIG. 10 is a view illustrating the blade rotated through a motor and a rotation guide according to an embodiment of the present disclosure.

FIG. 7 is an exploded perspective view of the damper device of the ventilation device shown in FIG. 1. FIG. 8 is a view illustrating the damper device having a blade rotating in a first direction according to an embodiment of the present disclosure. FIG. 9 is a view illustrating the damper device having a blade rotating in a second direction according to an embodiment of the present disclosure. FIG. 10 is a view illustrating the blade rotated by a motor and a rotation guide according to an embodiment of the present disclosure. Duplicate parts of the above descriptions may be omitted.

As shown in FIGS. 7 to 10, the ventilation device 1 may include the damper device 100 provided to be operated when the operating mode is selected, either the outdoor dehumidification mode in which the external air A3 is introduced into the indoor space I or the indoor dehumidification mode in which the internal air A4 is circulated into the indoor space I.

The damper device 100 may be provided to be available in both directions, such that the first housing 30 and the second housing 20 are inverted in the vertical direction Z to be applied to the ventilation device 1 in which the first type of ventilation device 1A and the second type of ventilation device 1B are symmetrically arranged in the left-right direction Y.

The damper device 100 may include a frame 110 in which a channel 200 is formed, a blade 300 rotatably coupled to the frame 110, and a motor 500 provided to rotate the blade 300.

The frame 110 may include an opening 111. The opening 111 of the frame 110 may be provided so that the channel 200 is formed therein. The frame 110 may be formed in a substantially rectangular shape. The opening 111 of the frame 110 may be formed in a rectangular shape. A channel forming portion 210 forming the channel 200 may be provided around the perimeter of the opening 111 of the frame 110.

The channel forming portion 210 of the frame 110 may be formed in a size and shape corresponding to the blade 300.

The channel forming portion 210 of the frame 110 may be formed in a rectangular shape.

The frame 110 may include a first bracket 120 and a second bracket 130 provided at upper and lower portions of the channel forming portion 210, respectively. The first bracket 120 may be provided on the upper portion of the frame 110 and the second bracket 130 may be provided on the lower portion of the frame 110. The first bracket 120 and the second bracket 130 may be provided to correspond to the upper and lower portions of the frame 110. As an example, the first bracket 120 is disposed on the upper portion of the channel forming portion 210 and the second bracket 130 is disposed on the lower portion of the channel forming portion 210, but the spirit of the present disclosure is not limited thereto. For example, the first bracket may be provided on the lower portion of the channel forming portion and the second bracket may be provided on the upper portion of the channel forming portion.

A motor installation portion 160 for installing the motor 500 may be provided on either the first bracket 120 or the second bracket 130. In an embodiment of the present disclosure, the motor installation portion is illustrated as an example formed on the second bracket 130, but the spirit of the present disclosure is not limited thereto.

The first bracket 120 and the second bracket 130 may each have a first hole 140 and a second hole 150 that may be mirrored. The first bracket 120 and the second bracket 130 may each have the first hole 140 and the second hole 150 that are symmetrically formed thereon. The first hole 140 and the second hole 150 formed in the first bracket 120 and the second bracket 130, respectively, may be positioned symmetrically with respect to each other. The first holes 141 and 142 and the second holes 151 and 152 formed in the first bracket 120 and the second bracket 130, respectively, may be formed to mirror each other.

The first bracket 120 may include a first hole 141 and a second hole 151 that are formed to be mirrored left and right. The first bracket 120 may have the first hole 141 and the second hole 151 formed symmetrically with respect to each other. The first hole 141 and the second hole 151 may be formed symmetrically on left and right sides of the first bracket 120.

The second bracket 130 may include a first hole 142 and a second hole 152 that may be mirrored. The second bracket 130 may have the first hole 142 and the second hole 152 formed symmetrically with respect to each other. The first hole 142 and the second hole 152 may be formed symmetrically on left and right sides of the second bracket 130.

The frame 110 may include the first hole 140 disposed in the vertical direction. The first hole 140 may include the first hole 141 formed in the first bracket 120 and the first hole 142 formed in the second bracket 130. The first holes 141 and 142 formed in the first bracket 120 and the second bracket 130, respectively, may be formed to be symmetrical to each other.

The frame 110 may include the second hole 150 disposed in the vertical direction. The second hole 150 of the frame 110 may include the second hole 151 formed in the first bracket 120 and the second hole 152 formed in the second bracket 130. The second holes 151 and 152 formed in the first bracket 120 and the second bracket 130, respectively, may be formed to be symmetrical to each other.

The blade 300 may be rotatably mounted in the first hole 140 located on one side of the frame 110. The blade 300 may be rotatably coupled to the first hole 141 of the first bracket 120 and the first hole 142 of the second bracket 130.

The blade 300 mounted in the first hole 140 of the frame 110 may be rotated in a first direction (i.e., counterclockwise (CCW)). The blade 300 coupled to the first hole 140 of the frame 110 may rotate in the first direction (CCW) to open and close the opening 111. The blade 300 mounted in the first hole 140 of the frame 110 may be rotated in the first direction (CCW) to open the channel 200.

Furthermore, the blade 300 mounted in the first hole 140 of the frame 110 may be rotated in a second direction (i.e., clockwise (CW)), which is opposite to the first direction (CCW), to close the channel 200.

The blade 300 may be rotatably mounted in the second hole 150 located on the other side of the frame 110. The blade 300 may be rotatably coupled to the second hole 151 of the first bracket 120 and the second hole 152 of the second bracket 130.

The blade 300 mounted in the second hole 150 of the frame 110 may be rotated in the second direction (CW). The blade 300 coupled to the second hole 150 of the frame 110 may rotate in the second direction (CW) to open and close the opening 111. The blade 300 mounted in the second hole 150 of the frame 110 may be rotated in the second direction (CW) to open the channel 200. In addition, the blade 300 mounted in the second hole 150 of the frame 110 may be rotated in the first direction (CCW), which is opposite to the second direction (CW), to close the channel 200.

The damper device 100 may be used in both directions by switching the assembly orientation of the blade 300 through the first hole 140 and the second hole 150, which are provided symmetrically in the frame 110.

The motor 500 provided to rotate the blade 300 will be described later.

The blade 300 may be provided to open and close the opening 111 of the frame 110. The blade 300 may be provided to open and close the channel 200.

The blade 300 may be formed in a rectangular shape. The blade 300 may be correspondingly provided to cover the opening 111.

The blade 300 may be formed as a rectangular plate. The blade 300 may include a first blade surface 310 and a second blade surface 320 formed on the opposite side of the first blade surface 310.

The blade 300 may further include a seal 400 that is provided in close contact with the channel forming portion 210 to maintain airtightness when the channel 200 is in a closed state. The seal 400 may be mounted on either the first blade surface 310 or the second blade surface 320 of the blade 300. The seal 400 may include a synthetic resin, a resin, or a rubber material. The seal 400 may be bonded to the blade 300 by adhesive or fusion.

The blade 300 may include hinge shafts 340 and 350 protruding from upper and lower ends of one side, respectively. The hinge shafts 340 and 350 of the blade 300 may be attached to the first hole 140 or the second hole 150 of the frame 110.

The hinge shafts 340 and 350 may include the first hinge shaft 340 protruding from the upper end and the second hinge shaft 350 protruding from the lower end.

The first hinge shaft 340 of the blade 300 may include a hinge protrusion 341 that protrudes upward. The second hinge shaft 350 of the blade 300 may include a hinge groove 351 that is recessed.

The first hinge shaft 340 of the blade 300 may be attached to the first hole 141 formed in the first bracket 120. The second hinge shaft 350 of the blade 300 may be coupled to the first hole 142 formed in the second bracket 130.

Any one of the first hinge shaft 340 and the second hinge shaft 350 of the blade 300 may be connected to the motor 500. In the embodiment of the present disclosure, it is shown as an example that the second hinge shaft of the blade is connected to the motor, but the spirit of the present disclosure is not limited thereto.

The motor 500 may be installed on the frame 110. The motor 500 may be connected to rotate the blade 300 through the first hole 140 and the second hole 150 formed in the frame 110.

The motor 500 may further include a motor mounting portion 501 provided to be mounted on the frame 110.

The motor 500 may be installed on the first bracket 120 or the second bracket 130 of the frame 110. The motor 500 may be coupled to the motor installation portion 160 provided on the second bracket 130. The motor installation portion 160 may be provided to correspond to the motor mounting portion 501 of the motor 500. The motor 500 may be fixed by a fixing member B penetrating the motor installation portion 160 through the motor mounting portion 501.

The motor installation portion 160 may include a pair of mounting holes 161 and 162 respectively formed near the first hole 142 and the second hole 152 formed in the second bracket 130.

The motor installation portion 160 may include the pair of first mounting holes 161 formed near the first hole 142. The motor installation portion 160 may include the pair of second mounting holes 162 formed near the second hole 152.

In the embodiment of the present disclosure, it is shown as an example that the motor installation portion is the mounting hole formed in the second bracket, but the spirit of the present disclosure is not limited thereto. For example, the motor installation portion may be a structure, such as a rib formed integrally with the first bracket or the second bracket.

The motor 500 may include a motor shaft 510. The motor shaft 510 may be provided to transmit a rotational force of the motor 500 to the blade 300.

The damper device 100 may further include a rotation guide 600 provided between the motor 500 and the blade 300 to guide the rotation of the blade 300. The rotation guide 600 may be provided to connect the motor 500 and the blade 300.

The rotation guide 600 may include a motor coupling 610 connected to the motor shaft 510 of the motor 500 and a hinge coupling 620 connected to the hinge shafts 340 and 350 of the blade 300. The hinge coupling 620 may be formed to extend integrally with the motor coupling 610.

The motor coupling 610 may be formed with a motor shaft coupling groove 611 of a corresponding shape so that the motor shaft 510 of the motor 500 is coupled thereto. The motor shaft coupling groove 611 may be coupled to the motor shaft 510 to allow the rotation guide 600 to rotate when the motor 500 rotates.

The hinge coupling 620 of the rotation guide 600 may further include a support surface 621 having a D-cut shape, i.e., a portion thereof is formed to be flat. The hinge groove 351, having a D-cut shape corresponding to be coupled with the support surface 621 of the hinge coupling 620, may be formed on the second hinge shaft 350 of the blade 300.

The blade 300 may be coupled to the hinge coupling 620 of the rotation guide 600 and may be rotated by receiving the rotational force of the motor 500. The blade 300 may be supported and rotated by the hinge groove 351 coupled to the D-cut support surface 621.

The blade 300 may be provided rotatably by attaching the first hinge shaft 340 and the second hinge shaft 350 to the first holes 140 of the frame 110. That is, the first hinge shaft 340 and the second hinge shaft 350 of the blade 300 may be attached to the first hole 141 formed in the first bracket 120 and the first hole 142 formed in the second bracket 130, respectively, to be rotatably provided. The blade 300 may be rotatably provided through the motor 500 mounted on the second bracket 130 and the second hinge shaft 350 connected by the rotation guide 600 coupled to the motor shaft 510 of the motor 500.

The blade 300 may be rotated, by the motor 500, in the first direction (CCW) to open the channel 200 of the frame 110, and in the second direction (CW), opposite to the first direction (CCW), to close the channel 200.

The frame 110 of the damper device 100 may include the second hole 150. The second hole 150 may be provided symmetrically with respect to the first hole 140. The second hole 150 may be formed symmetrically to be mirrored from the first hole 140. The second hole 150 may be formed in the first bracket 120 and the second bracket 130, respectively.

The second hole 150 may include the second hole 151 formed in the first bracket 120 and the second hole 152 formed in the second bracket 130.

The blade 300 may be rotatably mounted in the second hole 150 of the frame 110. The first hinge shaft 340 and the second hinge shaft 350 of the blade 300 may be attached to the second hole 151 formed in the first bracket 120 and the second hole 152 formed in the second bracket 130, respectively, to be rotatably provided. The blade 300 may be rotatably provided through the motor 500 mounted on the second bracket 130 and the second hinge shaft 350 connected by the rotation guide 600 coupled to the motor shaft 510 of the motor 500.

The blade 300 mounted in the second hole 150 of the frame 110 may be rotated in the second direction (CW). The blade 300 mounted in the second hole 150 of the frame 110 may be rotated in the second direction (CW) to open the channel 200.

In addition, the blade 300 mounted in the second hole 150 of the frame 110 may be rotated in the first direction (CCW), opposite to the second direction (CCW), to close the channel 200. The blade 300 may be rotated, by the motor 500, in the second direction (CW) to open the channel 200 of the frame 110, and in the first direction (CCW), opposite to the second direction (CW), to close the channel 200.

Therefore, the assembly direction of the blade 300 may be switched by the first hole 140 and the second hole 150 provided symmetrically in the frame 110, resulting in use in both directions.

FIG. 11 is a view illustrating the second type of ventilation device equipped with the damper device including the blade rotating in the second direction shown in FIG. 9.

In the following, the second type of ventilation device 1B will be described.

As shown in FIG. 11, in the case of the second type of ventilation device 1B, the first housing 30 may be placed on an upper side and the second housing 20 may be placed on a lower side in the vertical direction Z.

The first housing 30 may be provided to be inserted into the second cover 40, and the second housing 20 may be provided to be inserted into the first cover 50.

The components inside the housing 10, such as the dehumidifying device 80, the total heat exchanger 71, the filter 72, and the damper device 100, may be arranged inside the housing 10 in an inverted state with respect to the vertical direction Z compared to the first type of ventilation device 1A.

In other words, the blowing fans 61 and 62, the total heat exchanger 71, and the filter 72 accommodated within the second type of ventilation device 1B may be mounted on the housing 10 so as to be switched in the front-back direction X based on the front-back direction X of the first type of ventilation device 1A.

The damper device 100 may couple the first hinge shaft 340 and the second hinge shaft 350 of the blade 300 to the second holes 150, 151, and 152 of the frame 110. The blade 300 mounted in the second hole 150 of the frame 110 may be rotated in the second direction (CW) to open the channel 200.

Accordingly, in the indoor dehumidification mode, the internal air introduced into the ventilation device 1B through the second inlet 13 is not allowed to flow to the second outlet 14 through the total heat exchanger 71, and is allowed to flow into the second intake chamber 17*b* through the connecting flow path 19, leading to be circulated to the indoor space I by way of the dehumidifying device 80 and through the first outlet 12.

Furthermore, the blade 300 may be rotated in the first direction (CCW), opposite to the second direction (CCW), to close the channel 200.

When the channel 200 of the damper device 100 is closed, it is possible to prevent external air from flowing into the ventilation device 1B to be mixed with internal air.

As such, the damper device 100 according to an embodiment of the present disclosure may be implemented both in the first type ventilation device 1A in which the blades 300 may rotate in the first direction (CCW) to open the channel 200 and in the second type of ventilation device 1B in which the blades 300 may rotate in the second direction (CW) to open the channel 200.

While the present disclosure has been particularly described with reference to exemplary embodiments, it should be understood by those of skilled in the art that various changes in form and details may be made without departing from the spirit and scope of the present disclosure.

Although the present disclosure has been described with various embodiments, various changes and modifications may be suggested to one skilled in the art. It is intended that the present disclosure encompass such changes and modifications as fall within the scope of the appended claims.

What is claimed is:

1. A damper device comprising:

a frame having an opening;

a first bracket provided on the frame and including a first hole and a second hole that are bilaterally symmetrical to each other;

a second bracket provided to correspond to the first bracket and including a first hole and a second hole that are bilaterally symmetrical to each other;

a blade rotatably coupled to the first bracket and configured to open or close the opening; and a motor configured to rotate the blade through one of the first hole and the second hole, wherein when the blade is connected to the first hole, the blade is configured to be rotated in a first direction to open the opening, and when the blade is connected to the second hole, the blade is configured to be rotated in a second direction opposite to the first direction to open the opening, wherein one of the first bracket and the second bracket further includes a motor installation portion on which the motor is mounted, and wherein the motor installation portion further includes a plurality of mounting holes formed on one of the first bracket and the second bracket, adjacent to the first hole and the second hole thereof.

2. The damper device of claim 1, wherein the blade further includes a first hinge shaft and a second hinge shaft formed to be attached to the first hole and the second hole, respectively, of one of the first bracket and the second bracket.

3. The damper device of claim 2, further comprising a rotation guide provided between the motor and one of the first hinge shaft and the second hinge shaft to guide a rotation of the blade.

4. The damper device of claim 3, wherein the rotation guide includes:

a motor coupling coupled to a motor shaft of the motor, a hinge coupling extending integrally from the motor coupling and coupled to one of the first hinge shaft and the second hinge shaft.

5. The damper device of claim 4, wherein the hinge coupling further includes a support surface having a D-cut shape, a portion of which is formed to be flat.

6. The damper device of claim 5, wherein one of the first hinge shaft and the second hinge shaft further includes a hinge groove corresponding to the support surface and having a D-cut shape.

7. The damper device of claim 1, wherein the blade further includes a seal provided in close contact around the opening so as to maintain airtightness.

8. The damper device of claim 7, wherein the seal includes either a rubber or a resin.

9. A ventilation system includes:

a ventilation device including:

an intake flow path for drawing outdoor air into an interior of the ventilation device, an exhaust flow path for discharging indoor air to an outside, and a connecting flow path connecting the intake flow path and at least a portion of the exhaust flow path, a damper device provided to open and close the connecting flow path, wherein the damper device includes:

a frame having an opening, a first bracket provided on the frame and including a first hole and a second hole that are bilaterally symmetrical to each other, a second bracket provided to correspond to the first bracket and including a first hole and a second hole that are bilaterally symmetrical to each other, wherein the first hole and the second hole are formed in the first bracket and the second bracket to enable left and right mirroring, respectively, a blade including a hinge shaft attached to one of the first hole and the second hole to open and close the opening, and a motor provided to rotate the blade through the one of the first hole and the second hole, wherein when the blade is connected to the first hole, the blade is configured to be rotated in a first direction to open the opening, and when the blade is connected to the second hole, the blade is configured to be rotated in a second direction opposite to the first direction to open the opening, wherein one of the first bracket and the second bracket further includes a motor installation portion on which the motor is mounted, and wherein the motor installation portion further includes a plurality of mounting holes formed on one of the first bracket and the second bracket, adjacent to the first hole and the second hole thereof.

10. The ventilation system of claim 9, further includes:

a dehumidifying flow path provided on the intake flow path, and a heat exchanger to remove moisture in air flowing through the intake flow path, wherein the damper device is positioned on the dehumidifying flow path.

11. The ventilation system of claim 9, wherein the ventilation system includes a rotation guide provided between the motor and the hinge shaft to guide rotation of the blade.

12. The ventilation system of claim 11, wherein the hinge shaft includes a first hinge shaft formed on an upper side of the blade and a second hinge shaft formed on a lower side thereof.

13. The ventilation system of claim 12, wherein the rotation guide includes a motor coupling coupled to a motor shaft of the motor, and a hinge coupling extending integrally from the motor coupling and coupled to one of the first hinge shaft and the second hinge shaft.

14. The ventilation system of claim 13, wherein the hinge coupling further includes a support surface having a D-cut shape, a portion of which is formed to be flat.

15. The ventilation system of claim 14, wherein the one of the first hinge shaft and the second hinge shaft further includes a hinge groove corresponding to the support surface and having a D-cut shape.

16. The ventilation system of claim 9, wherein the blade further includes a seal provided in close contact around the opening so as to maintain airtightness.

* * * * *